US006183585B1

(12) United States Patent
Kelley

(10) Patent No.: US 6,183,585 B1
(45) Date of Patent: Feb. 6, 2001

(54) METHOD FOR MAKING CORNERS FOR LAMINATE AND VENEER COUNTERTOPS

(75) Inventor: Basil T. Kelley, P.O. Box 1053, Tualatin, OR (US) 97062

(73) Assignee: Basil T. Kelley, Sherwood, OR (US)

( * ) Notice: Under 35 U.S.C. 154(b), the term of this patent shall be extended for 0 days.

(21) Appl. No.: 09/012,754

(22) Filed: Jan. 23, 1998

(51) Int. Cl.[7] ..... B32B 31/00; A47B 13/08

(52) U.S. Cl. ..... 156/182; 156/257; 156/258; 156/267; 156/268; 156/293; 144/347; 144/350; 144/351; 52/782.2; 52/796.2

(58) Field of Search ..... 156/182, 256, 156/257, 258, 267, 268, 293; 144/347, 350, 351; 52/782.2, 796.12

(56) References Cited

U.S. PATENT DOCUMENTS 4,996,817 * 3/1991 Nelson ..... 52/782.2

5,310,435 * 5/1994 Kelly ..... 156/182

* cited by examiner

*Primary Examiner*—Linda L Gray
(74) *Attorney, Agent, or Firm*—Chernoff, Vilhauer, McClung & Stenzel, LLP

(57) ABSTRACT

A countertop is made having a laminate or veneer horizontal upper surface and a laminate or veneer vertical face, has a corner element with an arcuate surface that smoothly fairs into both the upper surface and the vertical face. The countertop is made by leaving the vertical edge of a deck unfinished and placing a vertical veneer strip on an edge piece which is then attached to the edge of the deck. The edge piece is made from a block having the vertical veneer strip attached to one of its sides. Diagonal cuts are made at the top and bottom of the face side of the block and rectangularly cross-sectioned strips, from which the corner elements will be formed, are glued to these cuts. The strips are then machined to form the smooth arcuate surfaces which will fair into the laminate surfaces. The back of the block is then machined to create the end piece which mates with the countertop deck.

6 Claims, 2 Drawing Sheets

METHOD FOR MAKING CORNERS FOR LAMINATE AND VENEER COUNTERTOPS

BACKGROUND AND SUMMARY OF THE INVENTION

This invention relates to countertops, and in particular to a smooth edge for laminate countertops.

Kelley U.S. Pat. No. 5,310,435 discloses a method for making a laminate countertop with a rounded thermoplastic solid surface corner piece which smoothly fairs into the laminate on the top and front edge of the countertop. This not only eliminates the black line which normally occurs at the corner of laminate countertops, but also a rounded corner is more aesthetically pleasing and is less easily damaged. In addition, the thermoplastic solid material is tougher than the laminate so the corner is less likely to be chipped.

In the method disclosed in the '435 patent, a rectangular notch is cut in the countertop edge piece and a rectangular corner element is glued in the notch. While a rectangular notch and corner element provide joinder where the corner element is not likely to be knocked out of the notch, the rectangular notch causes a significant amount of the corner element material to be imbedded in the edge piece which increases the cost of the corner.

The subject invention overcomes this shortcoming of the prior art by placing a laminate sheet on the upper surface of a horizontal deck having an exposed vertical edge and a laminate strip on the face side of a vertical edge piece as is done in the method described in the '435 patent. However, rather than cutting a rectangular notch in the corner of the edge piece to receive the corner element as with the prior art method, a diagonal cut is made across the horizontal upper corner of the face side of the edge piece. The rectangular corner element then is glued into this diagonal cut. A diagonal cut does not need to go as deep into the edge piece as a rectangular cut would for a given amount of projection of the corner element into the laminate sheet and laminate strip. Thus, the rectangular corner element can be thinner and therefore less expensive. In a preferred embodiment, the cut is v-shaped with the apex of the v being located at the intersection of the edge piece and the laminate strip.

As with the prior art method, a corner piece can be placed at the horizontal lower corner of the edge piece in the same manner.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
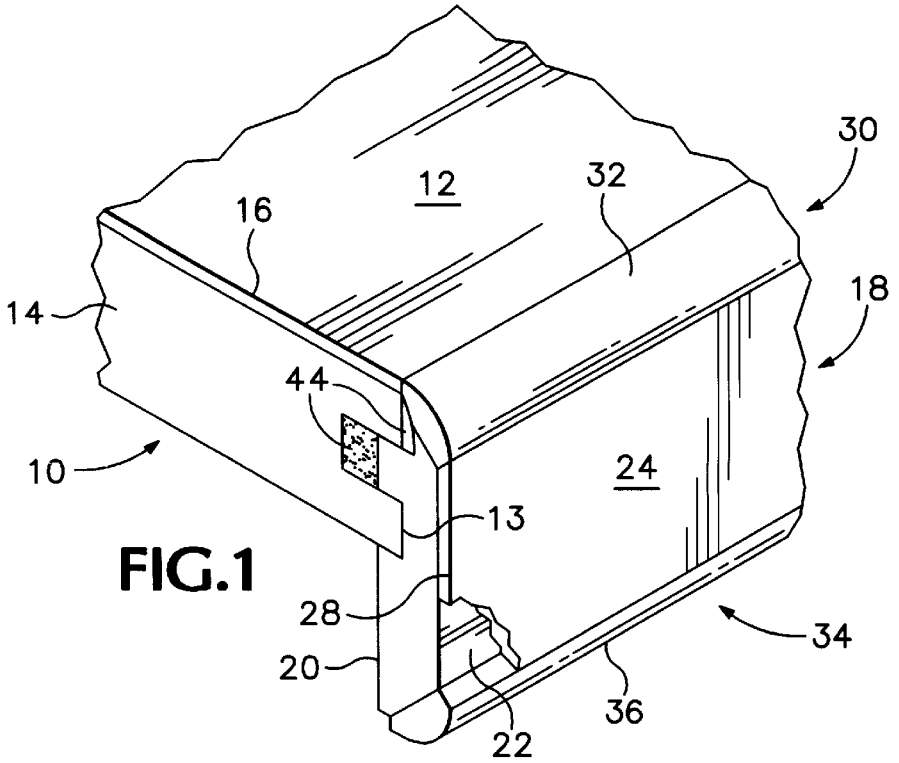
FIG. 1 is a fragmentary perspective view of a countertop embodying the subject invention.

Referring to FIG. 1 of the drawings, the countertop of the subject invention comprises a deck 10 having a horizontal finished upper surface 12 and an unfinished vertical edge 13. In the drawings, the deck is shown as an unfinished substrate 14 and the finished upper surface is a sheet of laminate 16 which is adhesively attached to the substrate. Countertops of this type are commonly used on kitchen cabinets and similar structures. However, the invention can also be utilized with decks made from veneer covered wood or similar materials, such as is used on tables, desks and other furniture items. The unfinished vertical edge 13 is covered by an edge piece 18 having a first planer side 20 which abuts the finished deck edge 13, and a second planer side 22 which is parallel with and opposed to the first side 20. The second side 22 of the edge piece 18 has a finished face 24, which is the same as or complimentary to the finished upper surface on the deck. In the embodiment illustrated, the edge piece is an unfinished substrate, and the finished face 24 is a strip of laminate 28 which is adhesively attached to the second side 22, however, the edge piece can also be veneer covered wood or other similar material.

The upper intersection of the deck and the edge piece contains a first corner element 30. The first corner element is attached to the upper edge of the edge piece and has a curved finished surface 32 which fairs into both the finished surface 12 of the deck and the finished face 24 of the edge piece. Thus, the first corner element eliminates the line which normally occurs between adjoining perpendicularly exposed laminate or veneer surfaces. A second corner element 34 is located at the lower edge of the edge piece to provide symmetry. The second corner element 34 has a curved surface 36 which fairs into the finished face 24 of the edge piece.

Figure 2:
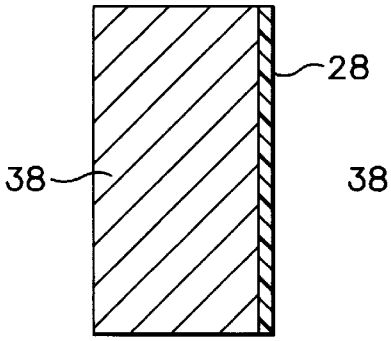
FIGS. 2–8 are cross-sectional views showing the sequence of construction of the edge piece of the countertop.
Figure 3:
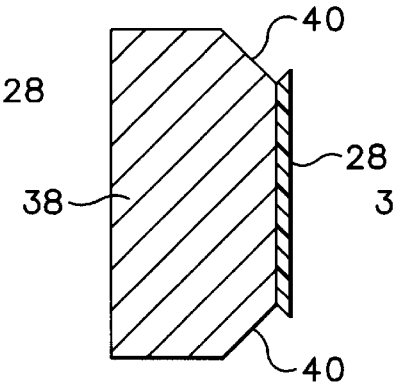
Figure 4:
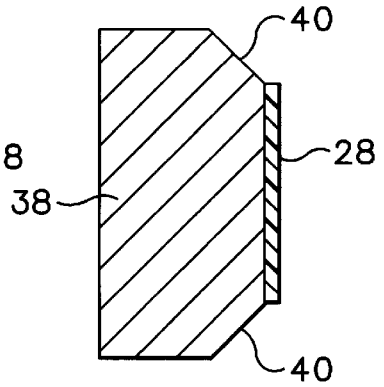
Figure 5:
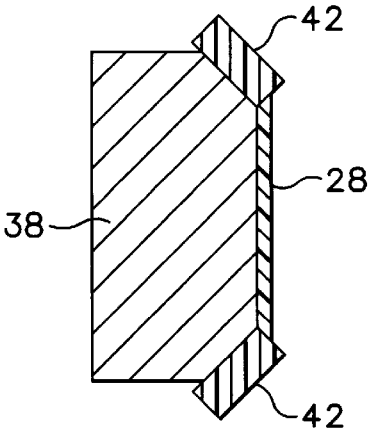

Referring to FIGS. 2–8, in a preferred embodiment the edge piece 18 is made from an elongate rectangularly cross-sectioned block 38 of substrate material which has approximately the same height as the desired edge piece but is somewhat thicker, FIG. 2. The laminate strip 28 is attached to one side of the block 38 and diagonal cuts 40 are made in the upper and lower edges of the laminate side of the block, FIGS. 3–4. In the embodiment illustrated, the diagonal cuts are v-shaped notches. The notch shown in FIG. 3 has an included angle of 90° and the notch shown in FIG. 4 is cut so that the portion of the cut that extends across the laminate strip 28 is substantially horizontal. The notches 40 are cut such that their apices are located at the intersection of the block 38 and laminate 28. If desired, the cuts in the block 38 and laminate strip can be made before the laminate strip is attached to the block. This technique works best for the embodiment shown in FIG. 4 but will work for the embodiment shown in FIG. 3 also.

Rectangular strips 42, of a surface material, which can be cut with a shaper, are placed in the notches 40 and secured to the block by means such as glue. The preferred material for the strips, when they are used with a laminate surface deck, is a solid surface thermo-plastic material of the type sold under the trademark CORIAN. The strips 42 are slightly larger in cross-section than the notches 40 and thus protrudes slightly above the front and ends of the block 38. Next, an arcuate surface is cut on the strips 42 with a shaper in a manner such that they fair into the laminate strip 28 on the front of the block 38, but still projects slightly from its ends, FIG. 6.

Figure 6:
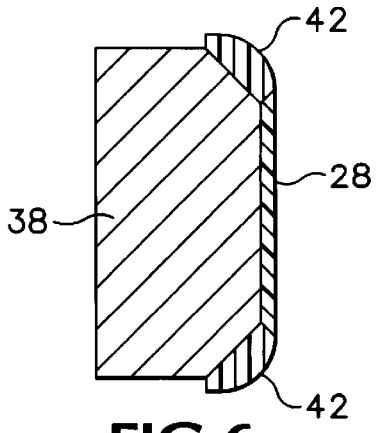
Figure 7:
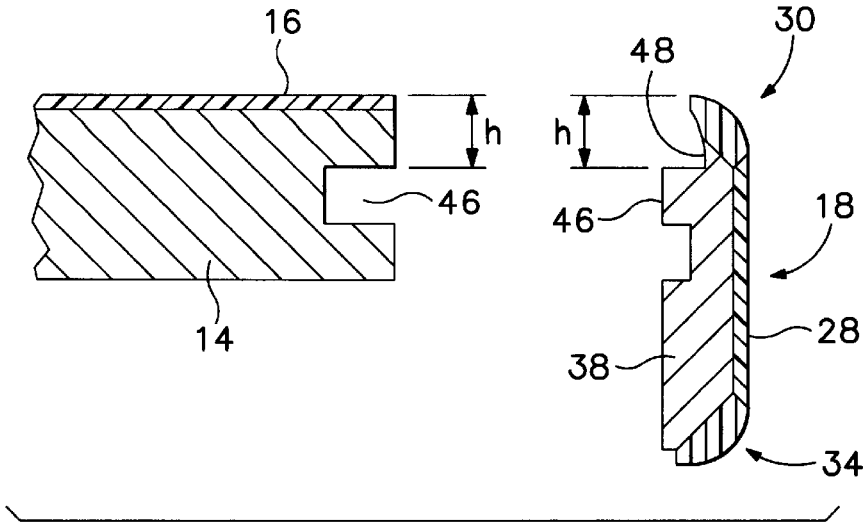
Figure 8:
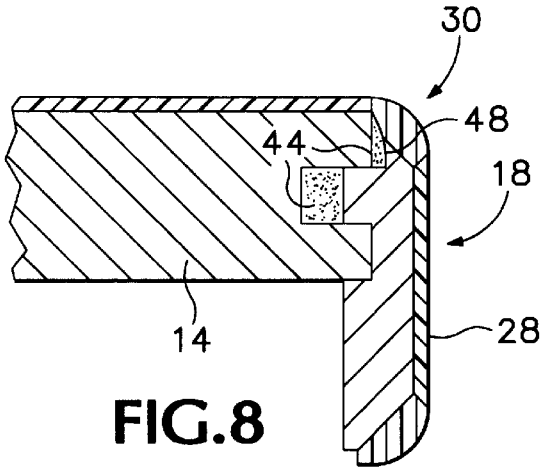
Figure 9:
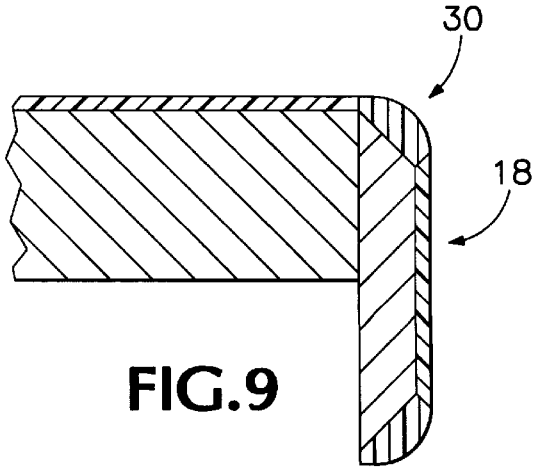
FIG. 9 is a cross-sectional view of another embodiment of the invention.

Finally, the backside of the block and the overhanging portions of the strip are cut with a router to form a finished end piece 18 that mates with the deck, thus forming the first corner element 30, FIG. 6. In a preferred embodiment, shown in FIGS. 1, 7 and 8, one side of a tongue-and-groove joint 46 is formed in the backside of the block 38, with the height between the edge of the first corner element 30 and -the tongue-and-groove joint 46 being a predetermined distance "h". The matching side of the tongue-and-groove joint can then be cut in the edge 13 of the deck substrate 14 with the distance between the top of the laminate sheet 16 and tongue-and-groove joint being equal to the distance "h". This permits the edge piece to me made in advance and then installed on a deck on site, and still have a smoothly faired surface between the deck laminate 16 and the first corner element 30. With this embodiment, the back of the block is cut to provide a glue slot 48 so that excess amounts of the glue 44 used to attach the edge piece to the deck will not be squeezed out onto the finished surfaces. If desired, the tongue-and-groove joint can be eliminated and the edge piece can be flush mounted on the deck as shown in FIG. 9.

Figure 10:
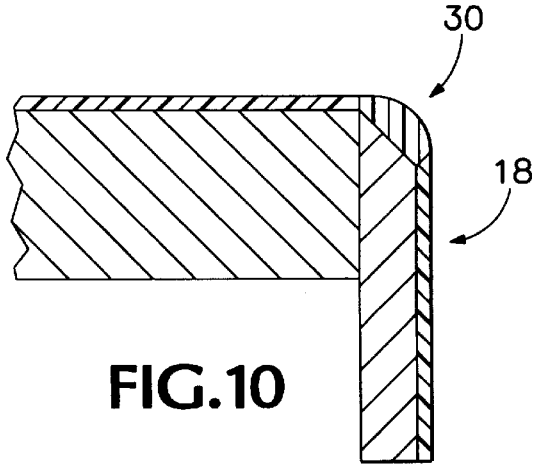
FIG. 10 is a cross-sectional view of yet another embodiment of the invention.

In an alternate embodiment of the invention, shown in FIG. 10, the second corner element is not used and the laminate strip 28 extends to the bottom of the edge piece 18. While this embodiment is shown without the tongue-and-groove joint, it can have the tongue-and groove joint also.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for forming a countertop comprising:

(a) placing a laminate sheet on the upper surface of a horizontal deck having an elongated exposed vertical edge;

(b) placing a laminate strip on the face side of a vertical edge piece having a length substantially equal to the length of said exposed vertical edge;

(c) making a first diagonal cut across the horizontal upper corner of the face side of said edge piece;

(d) adhesively joining in said first diagonal cut a first rectangularly cross-sectioned elongated corner element having transverse dimensions which cause it to extend outwardly from the top and face side of said edge piece, and a length substantially equal to the length of said edge piece;

(e) forming an arcuate surface on said first corner element that smoothly fairs into said laminate strip after said corner element has been attached to said edge piece; and (f) adhesively attaching said edge piece to said deck in a manner such that said edge piece covers the exposed vertical edge of said deck and said arcuate surface smoothly fairs into said laminate sheet.

2. The method of claim 1 wherein said cut is v-shaped with the apex being located at the intersection of said edge piece and said laminate strip.

3. The method of claim 1 wherein the portion of said cut that extends across said laminate strip is substantially horizontal.

4. The method of claim 1, including the additional step of forming tongue-and-groove joint elements in the edge of said deck and the backside of said edge piece that innerfit in a manner to cause said arcuate surface to smoothly fair onto said laminate sheet.

5. The method of claim 1, including the additional step of:

(a) Prior to attaching said corner element to said edge piece making a second diagonal cut across the lower corner of the face side of said edge piece;

(b) adhesively joining in said second diagonal cut a second rectangularly cross-sectioned elongated corner element having transverse dimensions which cause it to extend outwardly from the top and face side of said edge piece, and a length substantially equal to the length of said edge piece; and (c) forming an arcuate surface on said second corner element that smoothly fairs into said laminate strip.

6. A method for forming a countertop comprising:

(a) Placing a laminate sheet on the upper surface of a horizontal deck having an elongated exposed vertical edge;

(b) making a first diagonal cut across the horizontal upper corner of the face side of a vertical edge piece having a length substantially equal to the length of said exposed edge;

(c) placing a laminate strip on the face side of said edge piece below said diagonal cut;

(d) adhesively joining in said first diagonal cut a first rectangularly cross-sectioned elongated corner element having transverse dimensions which cause it to extend outwardly from the top and face side of said edge piece, and a length substantially equal to the length of said edge piece;

(e) forming an arcuate surface on said first corner element that smoothly fairs into said laminate strip after said corner element has been attached to said edge piece; and (f) adhesively attaching said edge piece to said deck in a manner such that said edge piece covers the exposed vertical edge of said deck and said arcuate surface smoothly fairs into said laminate sheet.

* * * * *